US005438324A

United States Patent [19]

Chyi et al.

[11] Patent Number: 5,438,324

[45] Date of Patent: Aug. 1, 1995

[54] GAS REMOVAL APPARATUS

[76] Inventors: Lindgren L. Chyi, 550 Hallandale Dr., Fairlawn, Ohio 44333; Thomas J. Quick, 4719 Quick Rd., Peninsula, Ohio 44264

[21] Appl. No.: 134,964

[22] Filed: Oct. 12, 1993

[51] Int. Cl.[6] ..... G08B 17/10

[52] U.S. Cl. ..... 340/632; 340/309.15; 454/909

[58] Field of Search ..... 340/632, 309.15; 454/239, 256, 341, 343, 354, 909

[56] References Cited

U.S. PATENT DOCUMENTS

| | | | |
|---|---|---|---|
| 3,826,180 | 7/1974 | Hayashi | 340/632 X |
| 3,901,813 | 8/1975 | Potopinski | 250/208.4 |
| 3,993,569 | 11/1976 | Zinsmeyer et al. | 250/208.4 |
| 4,110,632 | 8/1978 | Wyland | 307/117 |
| 4,277,693 | 7/1981 | Hoekman | 307/141 |
| 4,340,885 | 7/1982 | Chavis et al. | 340/632 |
| 4,383,251 | 5/1983 | Perelli et al. | 340/527 |
| 4,477,918 | 10/1984 | Nossen et al. | 377/37 |
| 4,523,630 | 6/1985 | Wiklund | 454/341 X |
| 4,530,107 | 7/1985 | Williams | 377/44 |
| 4,745,629 | 5/1988 | Essig et al. | 377/20 |
| 4,868,546 | 9/1989 | Dumbeck | 340/632 |
| 4,885,954 | 12/1989 | Franceus | 454/341 |
| 4,922,808 | 5/1990 | Smith | 454/341 |
| 4,995,309 | 2/1991 | Weaver | 454/354 |
| 5,257,736 | 11/1993 | Roy | 454/239 X |

*Primary Examiner*—Jeffery A. Hofsass
*Attorney, Agent, or Firm*—Hudak & Shunk Co.

[57] ABSTRACT

An apparatus for exhausting contaminant-laden air from a building area includes a monitoring device for determining when a contaminant level has exceeded a preselected value and which provides an output signal when the contaminant level has exceeded said preselected value, a motor-driven exhaust fan and associated conduit means for expelling air from the building area, and a timer-control circuit for actuating the exhaust fan for a predetermined period of time in response to an output signal from the monitor that the concentration of the contaminant has exceeded the preselected level. The apparatus allows for the removal of contaminants from an occupancy area of a building only when the level of the contaminant exceeds a preselected level, and only for a maximum predetermined period of time effective to reduce the amount of contaminant in the air to a safe level, thereby providing effective, energy efficient means for maintaining contaminant concentrations below a desired level.

19 Claims, 2 Drawing Sheets

GAS REMOVAL APPARATUS

FIELD OF INVENTION

The invention relates generally to an apparatus and method for removal of undesirable gases from interior building spaces and, more particularly, to an apparatus and method for exhausting air from a building space for a prescribed period of time in the event that the concentration of an undesirable component in the air exceeds a preselected level. The invention also relates to an electronic controller suitable for use with a gas removal apparatus, and which is capable of detecting a signal generated by a monitoring device when a particular condition is met and generating a control signal output to actuate an electric fan for a predetermined period of time in response to the detection of a signal from the monitoring device.

BACKGROUND

In response to health concerns relating to the accumulation of toxic, noxious and/or other undesirable fumes or gases in the occupancy areas of residential and other buildings, various air removal or exhaust systems are commonly used. Prior exhaust systems have generally included an exhaust fan and associated duct work for exhausting the air to the outside of the building. The exhaust fans for conventional air removal systems have been controlled either manually or by means of a programmable timer which actuates the fan periodically or for preselected time periods. Manually controlled exhaust systems are generally unreliable, ,especially for removing undesirable air contaminants which are imperceptible to the human senses. Timer-controlled exhaust systems are more reliable, but are still unresponsive to the actual concentration of an undesirable contaminant. The concentration of a contaminant in an occupancy area of a building is generally dependent on a variety of unpredictable factors such as air infiltration rates, heating, air conditioner and ventilation operation, and the extent to which windows and doors have been open. Accordingly, timer-controlled exhaust systems are not well suited for maintaining the level of undesirable contaminants below a prescribed level because they are either operated for a shorter time period than necessary, resulting in a possible health risk, or operated for a longer time than is necessary, which can result in a significant waste of energy due to the escape of heated or cooled air and unnecessary fan operation.

SUMMARY OF INVENTION

The present invention is directed toward an exhaust system for removing contaminant-laden air from the occupancy areas of a building to maintain the concentration of the contaminant below a prescribed level while minimizing operation of the system to reduce energy waste. The exhaust system includes an exhaust fan driven by an electric motor and associated duct work or other conduit means for expelling air from an occupancy area of a building, a means for monitoring the concentration of a contaminant in the occupancy area and for providing a signal when the concentration of the contaminant has exceeded a prescribed limit, and control means for actuating the exhaust fan for a period of time in response to the signal from the detector that the concentration of the contaminant has exceeded the prescribed limit.

In accordance with a preferred aspect of the invention, the control means includes a clock means for providing an electrical signal having a first value for a first predetermined time period and having a second value for a second predetermined time period, means responsive to the output signal from the monitoring means, and a logic circuit for generating a control signal to actuate the exhaust fan when the monitored condition meets a preselected condition during at least a portion of one of the predetermined time periods.

While the control means is particularly well suited for use with an exhaust system for removing contaminant-laden air from an occupancy area of a building, it is generally suitable for use as an electronic controller for detecting a signal from an external source and generating a control signal output for the remainder of a periodically reoccurring interval during which the square wave signal generated by the controller is high.

DETAILED DESCRIPTION OF INVENTION

Figure 1:
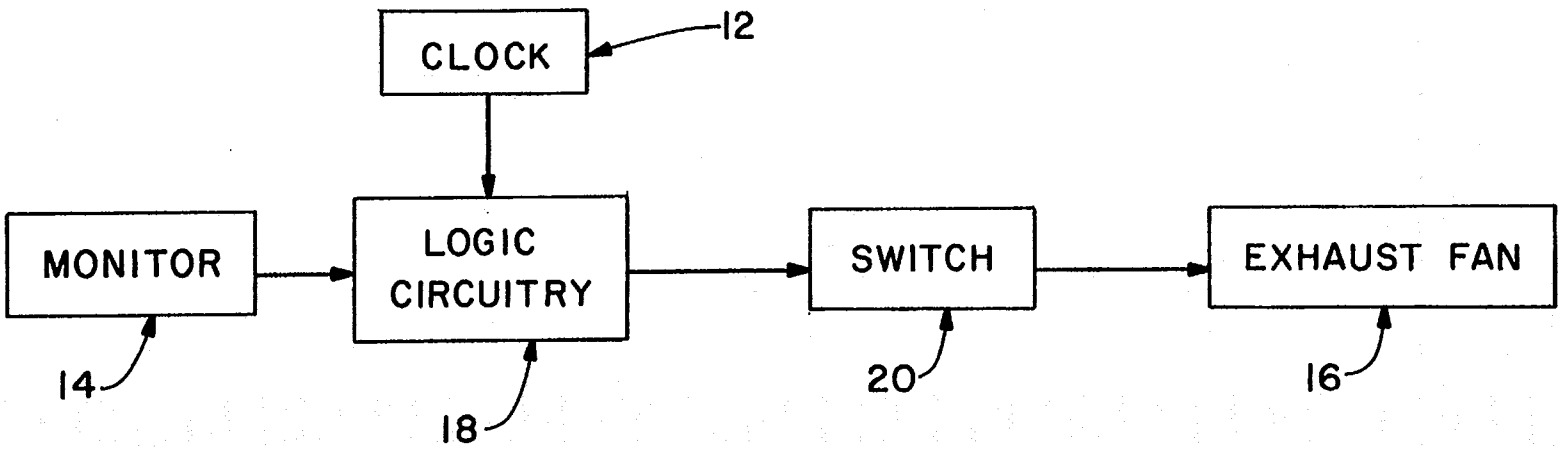
FIG. 1 is a block diagram of the exhaust system of the invention.

The invention broadly embraces exhaust systems responsive to one or more monitored conditions. With reference to the block diagram shown in FIG. 1, the exhaust system of the invention generally includes one or more means 14 for monitoring a condition and generating an output signal indicative of the monitored condition; an electrical exhaust fan 16; a control means 18 for receiving the one or more monitor output signals and providing an output control signal in response to the monitor output signal(s) and, hence, the monitored condition(s); and a switching means responsive to the control signal from the control means to supply electrical power to the exhaust fan.

The invention is particularly intended for removing contaminant-laden air containing undesirable gases or particulates from an occupancy area of a building. More specifically, the invention is well suited for exhausting soil gases, such as radon, carbon monoxide and methane, which can permeate or infiltrate through cracks in building foundations and basement walls, and accumulate within the building spaces, particularly in the basement. The ventilation fan intake and monitoring means are preferably located in or near the lowest possible position in the building where soil gases can tend to reach their highest concentrations. The ventilation system of the invention can be added to either new or existing buildings.

The control means can be generally any type of device for receiving the monitor output signal(s) and supplying power to the exhaust fan in response to the value or values of the monitor output signal(s). For example, the control means can be a simple device which includes means for detecting a single monitor signal which can, for example, indicate that the concentration of a particular air contaminant has exceeded a preselected value, and a clock means which provides a control signal to operate the fan for a predetermined period of time in response to the monitor signal. As another example, the control means can be a micro or mini-computer capable of receiving a plurality of different monitor output signals each of which provides specific quantitative information relating to a monitored condition, capable of processing the information provided by the monitoring means in accordance with a complex algorithm, and capable of providing a variable output control signal to operate a variable speed exhaust fan.

The invention will be described in greater detail relative to specific non-limiting embodiments.

Figure 2:
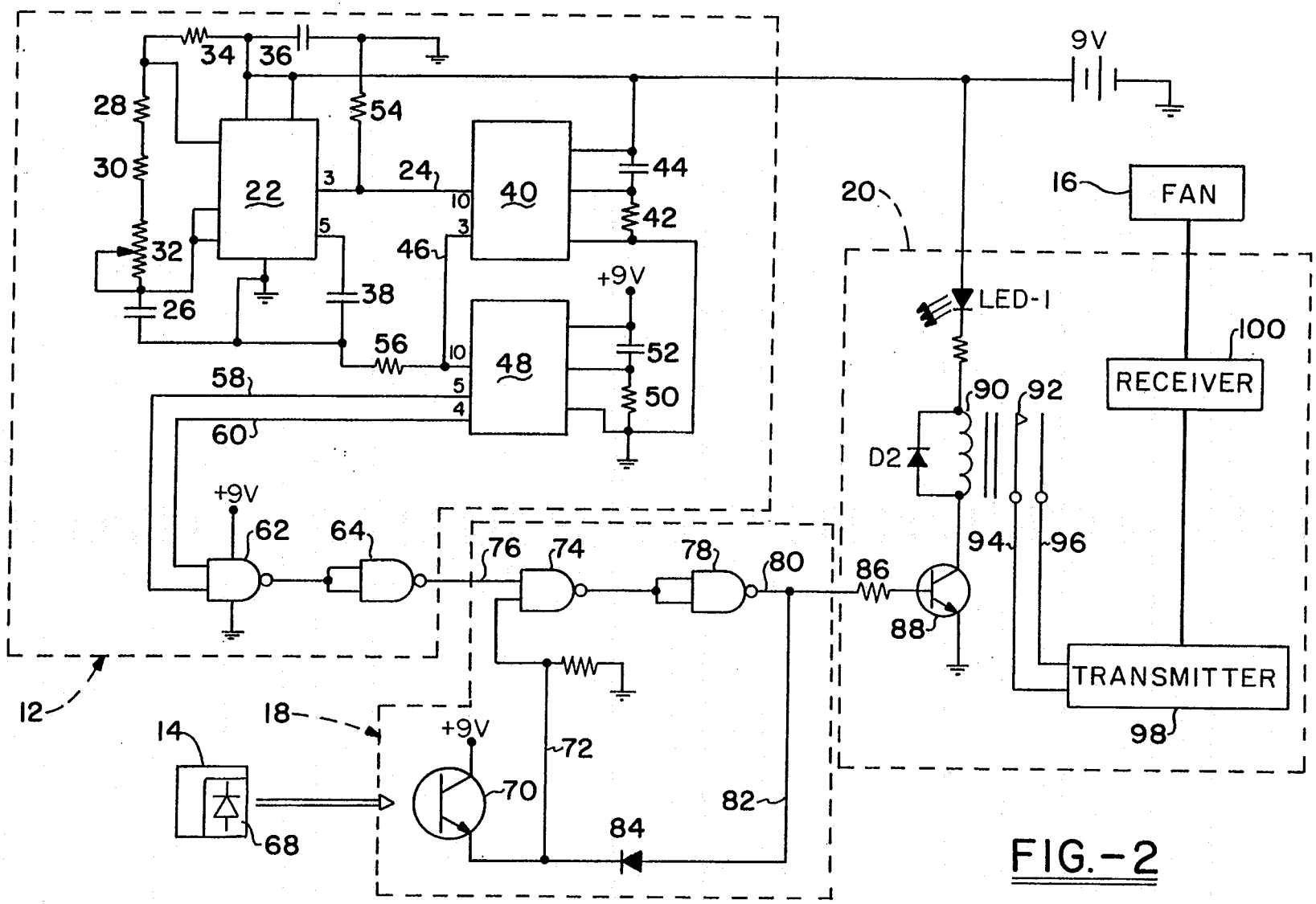
FIG. 2 is a detailed schematic of a preferred embodiment of the invention.

In accordance with a preferred embodiment shown in FIG. 2, the control means includes a clock means 12 generally comprising any conventional means for generating a periodic or repeating signal which is low (generates a logical 0) during a first predetermined period of time and high (generates a logical 1) during a second predetermined period of time. The clock means generally includes any of various electrical timers or oscillators capable of generating a timing signal and one or more counters for counting a predetermined number of pulses from the oscillator or another counter and providing a lower output frequency. Optionally, the clock means 12 can include one or more logic gates for accepting the outputs from a plurality of counters and providing a periodic electrical output signal which is low during a first predetermined time period and high during a second predetermined time period which is different from the first predetermined time period.

The clock means 12 includes a CMOS 555 timer chip 22 (part number LMC555 available from Digi-Key, Inc.) configured in an astable (free-running) mode and which provides a relatively high frequency timing signal. The frequency of the timing signal carried by conductor 24 from pin 3 of the timer chip 22 is dependent on the capacitance of capacitor 26 and the total resistance of resistors 28 and 30 and variable resistor 32. In accordance with the specific illustrative example, capacitor 26 has a capacitance of 0.01 microfarads and the total resistance of resistors 28, 30 and 32 is 495.8 kohms, thereby providing a timing signal carried by conductor 24 which is a square wave having a frequency of about 145.64 hertz. In accordance with the specific illustrative example, resistor 34 has a resistance of about 4.7 kohms, and capacitor 36 which helps filter the supply voltage has a capacitance of about 47 microfarads. Capacitor 38 is used to bypass pin 5 of the timer chip and has a capacitance of about 0.1 microfarad. The timing signal carried by conductor 24 is input to pin 10 of a CMOS binary ripple counter 40 (part number CD 4020 available from Digi-Key, Inc.). In accordance with the specific illustrative example, 100 kohm resistor 42 along with 0.1 microfarad capacitor 44 will reset the counter 40 when power is applied. The timing signal input to pin 10 of the binary ripple counter 40 is divided by $2^{14}$ by counter 40, with the output signal from pin 3 of counter 40 (having a frequency of about 0.00889 hertz) carried by conductor 46 to pin 10 of binary ripple counter 48 (which is another part number CD 4020 available from Digi-Key, Inc.). In accordance with the example, 100 kohm resistor and 0.1 microfarad capacitor 52 are used to reset the counter when power is applied, and 10 kohm resistors 54 and 56 are used to load the respective output signals. The binary ripple counter 48 provides a timing signal output at pin 5 thereof having a frequency of about 0.0002777, which is equal to the input signal frequency at pin 10 to counter 48 (about 0.00889 hertz) divided by $2^5$. At pin 4 of counter 48 an output frequency of about 0.0001389 hertz, equal to the input frequency at pin 10 of counter 48 divided by $2^6$, is provided. The output timing signals from counter 48 carried by conductors 58 and 60 are square waves having periods of about one hour and two hours, respectively. The two timing signals carried by conductors 58 and 60 are supplied to the inputs of NAND gate 62. The output from NAND gate 62 will be continuously low for a period of 0.5 hour every two hours, and continuously high during the remaining 1.5 hours during every two-hour period. The output from NAND gate 62 is supplied to each of two inputs to NAND gate 64 which acts as an inverter generating an output signal which is continuously high for 0.5 hour out of every 2 hours and low during the remaining 1.5 hours of every two-hour period. The output from NAND gate 64, which constitutes the output from clock means 12, is a periodic electrical signal which is low during a first predetermined time period (e.g., 1.5 hour) and high during a second predetermined time period.

The foregoing detailed description of the clock means 12 of FIG. 2 is merely illustrative, as those of ordinary skill in the art will readily appreciate that there are various modifications that can be made to the clock circuit 12 to provide other predetermined time periods. For example, NAND gate 64 can be passed or eliminated from the foregoing illustrative example to provide a periodic electrical signal which is continuously high for 1.5 hours and continuously low for 0.5 hour during every two-hour period, or the output from pin 5 of counter 48 can be split and provided to each of the inputs of the NAND gate 62 to generate a signal which is continuously high for 0.5 hour and continuously low for 0.5 hour for every one-hour period. The timing circuit or clock means 12 of FIG. 2 can also be modified by changing the resistances of resistors 28, 30 and 32 and the capacitance of capacitor 26 to generate a timing signal output from timer chip 22 of generally any desired frequency. By properly selecting a frequency for the output from timer chip 22 and utilizing one or more counters, with or without one or more logic gates, it is possible to generate a periodic output signal from the clock means 12 which is high for any desired time period and low for any other desired time period.

The exhaust system of the invention includes a monitoring device 14 for monitoring a condition and generating an output signal detectable by the control circuit 18 when the monitored condition meets a preselected criteria.

A particularly well suited application of the invention is in the field of home radon reduction. In this case, the monitoring devices 14 is a radon detector which is preferably capable of continuously monitoring the amount of radiation emitted by Radon-222($^{222}$Rn) in the air and which is capable of providing a signal which is detectable by the control circuit 18 when the radiation level from Radon-222 exceeds a preselected value. A commercially available radon detector (e.g., Radon Alert, available from Monitor Technologies, Ltd.) suitable for use with the exhaust system of the invention is capable of continuously monitoring the radiation level caused by Radon-222 and energizing a light-emitting diode 68 when the radiation level exceeds a preselected value. In this case the control circuit or control means 18 would include means responsive to the light-emitting diode.

While the invention is believed to be particularly well suited for home radon reduction, it can also be used with other monitoring devices and/or in other environments to reduce the amounts of other air contaminants such as smoke, carbon monoxide,etc.

Additionally, while the invention in accordance with the preferred embodiment shown in FIG. 2 includes a monitoring device which provides an electromagnetic wave output in the form of visible, ultraviolet, or infrared light, or a combination thereof, the exhaust system of the invention can include monitoring means which generate, and control means 18 which are responsive to, other types of output signals, including digital or analog electrical signals.

The control means or circuit 18 is a logic circuit which includes means responsive to the output signal from the monitoring means 14, and a logic network or circuit for generating a control signal to actuate a switching means 20 to supply electrical power to the exhaust fan 16 when the monitored condition meets a preselected criteria during at least a portion of one of the predetermined time periods. In accordance with the preferred embodiment of the invention shown in FIG. 2, the control means includes a photoelectric sensor 70 which has very low conductivity (i.e., very high internal resistance) in the absence of light, with the result that very little current is drawn through the photoelectric sensor which in turn results in a low or logical 0 electrical signal which is supplied by conductors 72 to NAND gate 74. To prevent stray light from actuating the photoelectric sensor 70, it is desirable that the light-emitting diode 68 of monitor 14, and the photoelectric sensor 70 of control means 18 be placed in close proximity to one another and that the light path between sensor 70 and diode 68 be shielded from light such as by placing a straight opaque tube between the diode 68 and sensor 70 which allows light to pass therethrough but which prevents stray light from entering therein. Also, it may be desirable to select a photoelectric sensor 70 which is particularly responsive to the predominate frequency of the light emitted by the light-emitting diode 68. For a typical red light-emitting diode, a phototransistor such as Radio Shack part number 276–145 can be used. When the signal supplied to NAND gate 74 through conductor 72 is low, the output from NAND gate 74 is always high regardless of whether the signal supplied to NAND gate 74 by conductor 76 from the clock means 12 is high or low. The output from NAND gate 74 is split and supplied to each of the input terminals of NAND gate 78 which accordingly acts as an inverter. Therefore, the output from NAND gate 78, which is the control-signal from control means 18 to switch means 20 is low as long as light from the light-emitting diode 68 is not supplied to the photoelectric sensor 70. Likewise, the output signal from NAND gate 78 is low regardless of whether or not light is supplied to the photoelectric sensor 70, unless the output from the clock means 12 supplied by conductor 76 to NAND gate 74 is also high. When light from light-emitting diode 68 is supplied to photoelectric sensor 70 the resistance thereof goes down causing current to flow therethrough and delivering a high or logical one electrical signal to NAND gate 74 through conductor 72. When the output clock signal delivered to NAND gate 74 and the signal supplied to NAND gate 74 through conductor 72 are both high then, and only then, is the output from the control means high. The output control signal from the control means 18 is carried by conductor 80 to the switching means 20 which supplies power to fan 16 when the output control signal is high. While the control circuit 18 can be configured to deliver a high output only while the clock signal carried by conductor 76 to the control circuit, and the output signal from photoelectric sensor 70 carried by conductor 72 are both high (by omitting conductor 82 and diode 84), it is preferred that the control circuit be configured to supply a high signal to the switching means 20 for the remainder of any predetermined time period in which a high signal was supplied by photoelectric sensor 70 to NAND gate 74 while the clock output is high, regardless of whether or not the signal from the emitter of photoelectric sensor 70 subsequently becomes low during the remainder of that predetermined time period. Accordingly, conductor 82 is provided to carry the output signal from NAND gate 78 back to the same input terminal of NAND gate 74 to which the output from the photoelectric sensor 70 is supplied. This ensures that if a high signal is supplied by photoelectric sensor 70 through conductor 72 anytime while the clock signal to the other input terminal of NAND gate 74 is high, the control signal from the control means 18 delivered to the switching means 20 will remain high resulting in continuous fan operation during the remainder of the time that the clock signal remains high. Diode 84 prevents current flow from the photoelectric sensor 70 to the switching means 20. The control means 18 preferably includes conductor 82 to prevent rapid on/off cycling of the exhaust fan by ensuring that the fan remains on for a time sufficient to achieve a substantial departure from the preselected criteria (such as Radon-222 radiation level) of the monitored condition which causes actuation of the exhaust fan.

The means responsive to the output signal from the monitoring means 66 can include generally any appropriate means for detecting an output signal from the monitoring means and converting it to a high or logical one electrical signal. For example, if the monitoring device is provided with an electrical output signal, then an appropriate conventional electrical sensing circuit for converting the particular type electrical signal output from the monitor to a high or logical one electrical signal can be used. For instance, if the monitoring device has an analog electrical output then that output can be properly grounded, loaded, and passed through an appropriate zener diode, with photoelectrical sensor 70 being replaced by a transistor, such that the output from the anode of the zener diode is input to the base of the transistor, with the emitter terminal of the transmitter being connected to one of the inputs of NAND gate 74 such as by conductor 72. Other conventional means for converting various conventional monitor outputs into a suitable logical signal for use with the logic circuitry of control means 18 will be readily apparent by those of ordinary skill in the art and are within the scope of the invention.

The switching means, in accordance with the preferred embodiment shown in FIG. 2, includes a resistor 86 for limiting the current from the output of NAND gate 78 to the base of transistor 88. A high output signal from the control means turns on transistor 88 causing relay 90 to become energized which in turn closes switch 92 closing the circuit between contacts 94 and 96. The contacts 94 and 96 are wired to an interface or transmitter 98, such as Radio Shack part number 61-2687. The interface 98 is powered by a standard household current. An electrical control signal is transmitted from the universal interface through the house wires to an appliance module or receiver 100, such as Radio Shack part number 61-2684. The Signal from the transmitter 98 energizes the output of the receiver 100. A standard exhaust fan 16 (e.g., 0.60 hp, 1,125 amp, 120 V, with an air throughput of 230 ft3/min., Model AD 760 2 Ventilator from Spartan Electric Co.) is connected to the receiver 100 and is powered when the receiver 100 is energized. The receiver 100 and transmitter 98 are by way of further example "X-10" power line impressed-carrier control devices.

The foregoing description of the switching means 20 represents a convenient means for situating the fan 16 at a location remote from the monitoring means and the control means without having to run additional wiring therebetween. Various other conventional means for supplying power to fan 16 in response to a high or logical 1 signal output from control means 18 will be readily apparent to those of ordinary skill in the art and are considered to fall within the scope of the invention. For example, one of the contacts 94 or 96 can be connected to an AC power supply and the other wired directly to the fan, thereby eliminating the need for interface 98 and receiver 100. Also, relay 90 can be replaced by any of various known electronic switches.

A suitable power source for the electronic circuitry of FIG. 2 is a universal AC to DC adapter (such as Radio Shack part number 273-1650) set at 9 VDC output. While the various components of the invention have been conveniently described with respect to their function, NAND gates 62, 64, 74 and 78 preferably constitute a single commercially available integrated circuit, such as part number C04011 from Digi-Key, Inc.

The foregoing description wherein the periodic clock signal from clock means 12 is high for 0.5 hour and low for 1.5 hours, and wherein a fan capable of exhausting 230 cubic feet per minute is illustrative of an exhaust system for removing Radon-222 from a residential dwelling having a rectangular basement of about 40 feet by about 25 feet. The radon detector is set to provide a light signal from light-emitting diode 68 when the radiation level exceeds 4 picocuries. The second predetermined time period of 0.5 hour wherein the signal from the clock means 12 is high, approximately represents the maximum amount of time required for the fan to exhaust a sufficient amount of Radon-222 Radon air to reduce the radiation level to about 2 picocuries (one-half of the action limit). The first predetermined time period of 1.5 hours approximately represents the minimum amount of time in which the radiation level can rise from 2 to 4 picocuries. While the foregoing example is believed to be suitable for a typical residential dwelling, the actual length of the predetermined time periods and fan capacity are dependent on a number of factors including air infiltration rates, the size of the occupancy area, and the desired range which is to be maintained for the monitored condition. Suitable time periods and fan capacities can be estimated or determined experimentally for a particular building by conventional methods known by those of ordinary skill in the ventilation field.

In the case of radon reduction, because the concentration of radon gas is generally highest near the basement floor, the air inlet of the exhaust fan is preferably located near the floor at one corner of the basement with the radon monitor being located near the opposite corner of the basement. The air from the fan is exhausted outside of the building such as through flexible conduits.

While in accordance with the patent statutes the best mode and preferred embodiment has been set forth, the scope of the invention is not limited thereto, but rather by the scope of the attached claims.

What is claimed is:

1. An exhaust system comprising:

means for monitoring an air contaminant and for providing a monitor output signal when the air contaminant exceeds a preselected limit, an exhaust fan driven by an electric motor, control means including a clock means for providing a periodic electrical signal of a first value during a first predetermined time period and of a second value during a second predetermine time period, said controlled means being responsive to the monitor output signal and generating a control output signal during any remaining portion of the first predetermined time period after the air contaminant exceeds the preselected limit, and switching means responsive to the control output signal to supply electrical power to the exhaust fan motor during the remaining portion of the first predetermined time period after the air contaminant exceeds the preselected limit.

2. An exhaust system as set forth in claim 1, wherein said clock means include an oscillator for supplying a timing signal and at least one counter for counting a predetermined number of pulses of the timing signal and supplying a counter output signal having a lower frequency than said timing signal from said oscillator.

3. An exhaust system as set forth in claim 2, wherein the control means further comprises one or more logic gates for accepting the outputs from said at least one counter and for providing said periodic electrical signal.

4. An exhaust system as set forth in claim 1, wherein the monitoring means is a radon detector which provides the monitor output signal when the radiation emitted by radon-222 exceeds a preselected level.

5. An exhaust system as set forth in claim 4, wherein the output signal from the radon detector is an electromagnetic signal emitted from a light source of the radon detector.

6. An exhaust system as set forth in claim 2, wherein the control means includes a logic circuit and means for supplying a signal to said logic circuit when said monitoring means provides the monitor output signal, said logic circuit being coupled to said clock means to receive said periodic electrical signal and said logic circuit supplying said control output signal to said switching means to operate said fan when said periodic electrical signal is said first value and said monitoring means provides the monitor output signal.

7. An exhaust system as set forth in claim 6, wherein the control output signal is supplied to said switching means to operate said fan for the remaining portion of said first predetermined time period irrespective of whether said monitoring means continues to provide the monitor output signal during the remaining portion of said first predetermined time period.

8. An exhaust system as set forth in claim 6, wherein said monitor output signal is provided by a light-emitting source and said means for supplying a signal to said logic circuit when said monitoring means provides the monitor output signal comprises photoelectric sensing means, said light-emitting source being electrically isolated from said control means.

9. An exhaust system as set forth in claim 8, wherein said switching means includes a transistor means and a relay switch, the control output signal being supplied to the base of said transistor means allowing current to flow from an emitter of said transistor when said control output signal is supplied, thereby energizing said relay switch to provide power to said fan motor.

10. A timer-control means comprising a clock means for providing a periodic electrical signal which is of a first value during a first predetermined period and which is of a second value during a second predetermined time period, means for detecting a signal generated by a monitoring device when a monitored condition meets a preselected criteria, and circuit control means for generating a control signal to actuate a switching means to supply electrical power to an exhaust fan when said periodic electrical signal is said first value after a signal generated by said monitoring device is detected.

11. A timer-control means as set forth in claim 10, wherein the clock means comprises an oscillator for supplying a timing signal and at least one counter for counting a predetermined number of pulses of the timing signal and supplying said periodic electrical signal to said circuit control means.

12. A timer-control means as set forth in claim 10, wherein the clock means comprises an oscillator for supplying a timing signal and at least one counter for counting a predetermined number of pulses of the timing signal and supplying a counter output signal having a lower frequency than said timing signal from said oscillator, and one or more logic gates for accepting the outputs from said at least one counter and for providing said periodic electrical signal.

13. A timer-control means as set forth in claim 12, further comprising a logic circuit and means for supplying a signal to said logic circuit in response to said monitor output signal, said logic circuit being coupled to said clock means to receive said periodic electrical signal, and said logic circuit supplying a control output signal to operate said exhaust fan in response to said monitor control signal when said periodic electrical signal is said first value.

14. A timer-control means as set forth in claim 13, wherein the control output signal remains at said first value for the remaining portion of said first predetermined time period irrespective of said monitor output signal during the remaining portion of said first predetermined time period.

15. A timer-control means as set forth in claim 14, wherein said monitor control signal is provided by a light-emitting source and said means for supplying a signal to said logic circuit in response to said monitor output signal comprises photoelectric sensing means.

16. An apparatus for removing contaminant-laden air from an occupancy area of a building to maintain the concentration of a contaminant below a prescribed level, said apparatus comprising:

a motor-driven exhaust fan and associated conduit means for expelling air from the occupancy area of the building, means for monitoring the concentration of a contaminant and for providing a monitor output signal when the concentration of said contaminant has exceeded a prescribed level, and means for actuating the exhaust fan, said actuating means including an electrical timer for generating a periodic timing signal which is of a first value during a first predetermined time period and which is of a second value during a second predetermined time period, and a logic circuit which is responsive to said timing signal and said monitor output signal, and which 17. An apparatus as set forth in claim 16, wherein said contaminant is Radon-222 and said monitoring means is a radon detector generates a control output signal to actuate said exhaust fan for any remaining portion of said first predetermined time period after said monitor has provided said monitor output signal.

18. An apparatus as set forth in claim 16, wherein said clock means comprises an oscillator for supplying a timing signal and at least one counter for counting a predetermined number of pulses of the timing signal and supplying an output signal having a lower frequency than said timing signal from said oscillator.

19. An apparatus as set forth in claim 18, wherein said means responsive to the monitor output signal and the periodic electrical signal includes a logic circuit, and means for supplying a signal to said logic circuit when said monitoring means provides the monitor output signal, said logic circuit being coupled to said clock means to receive said periodic electrical signal and said logic circuit supplying a control output signal to operate said fan when said periodic electrical signal is said first value and said monitoring means provides said monitor output signal.

* * * * *